United States Patent [19]

Levine et al.

[11] 4,327,123

[45] Apr. 27, 1982

[54] METHOD OF METALLIZING A PHOSPHOR SCREEN

[75] Inventors: Aaron W. Levine, Lawrenceville; Kazimiera D. Tomeczek, Hamilton Square, both of N.J.; Stanley A. Harper, New Providence, Pa.

[73] Assignee: RCA Corporation, New York, N.Y.

[21] Appl. No.: 236,243

[22] Filed: Feb. 20, 1981

[51] Int. Cl.[3] ..... H01J 29/22; B05D 1/38; B05D 7/22; B05D 3/02

[52] U.S. Cl. ..... 427/64; 427/68

[58] Field of Search ..... 427/64, 68

[56] References Cited

U.S. PATENT DOCUMENTS

| | | | |
|---|---|---|---|
| 3,067,055 | 12/1962 | Saulnier | 427/68 X |
| 3,574,663 | 4/1971 | Schniepp | 427/68 |
| 3,579,367 | 5/1971 | Patel | 427/68 X |
| 3,582,389 | 6/1971 | Saulnier | 427/68 |
| 3,582,390 | 6/1971 | Saulnier | 427/68 X |
| 4,122,213 | 10/1978 | Ito et al. | 427/64 |
| 4,139,657 | 2/1979 | Watanabe | 427/68 |

*Primary Examiner*—James R. Hoffman

*Attorney, Agent, or Firm*—E. M. Whitacre; D. H. Irlbeck; L. Greenspan

[57] ABSTRACT

A method of metallizing a phosphor screen including the steps of coating the phosphor screen with an aqueous emulsion containing an acrylic copolymer, drying the coating and depositing a metal layer on the dry coating, the copolymer consists essentially of about 34 to 80 weight percent of one member of the group consisting of methyl methacrylate and ethyl methacrylate, 20 to 60 weight percent ethyl acrylate and 1 to 14 weight percent methacrylic acid.

The emulsion may contain minor amounts of (a) colloidal silica, (b) water-soluble polymer and/or (c) dispersing agent.

8 Claims, No Drawings

METHOD OF METALLIZING A PHOSPHOR SCREEN

BACKGROUND OF THE INVENTION

This invention relates to a novel method of metallizing a phosphur screen and particularly to such a method which uses an aqueous emulsion of acrylic copolymers in a particular compositional range.

A proces of metallizing a phosphor screen for a cathode-ray tube is described in U.S. Pat. No. 3,067,055 issued on Aug. 5, 1959, to T. A. Saulnier, Jr. That process includes the steps of coating the screen with an aqueous emulsion containing an alkyl methacrylate-methacrylic acid copolymer, heating and drying the coating to produce a dry volatilizable substrate, depositing a layer of metal on the surface of the substrate and then volatilizing the substrate, leaving the metal layer in contact with the screen. In addition to the copolymer, the emulsion may contain minor amounts of one or more additives such as colloidal silica, a boric acid complex of polyvinyl alcohol and hydrogen peroxide, as described and for the reasons disclosed, for example, in U.S. Pat. No. 3,582,390 issued on June 1, 1971 to T. A. Saulnier.

As used herein, the combination of steps for producing the substrate is referred to as "filming," and the particular filming process described above is referred to as "emulsion filming." The emulsion used for coating the screen is called the "filming emulsion." The filming emulsion has as its major constituent a "latex" whose discontinuous phase consists essentially of particles of an organic copolymer. The step of volatilizing the substrate is called "baking-out."

While emulsion filming has been used successfully for the manufacture of millions of color television picture tubes, it has the disadvantage that very few latexes are known which can be successfully employed to prepare the filming emulsion. In fact, virtually all kinescope manufacturers that employ emulsion filming base their filming emulsions on a commercial product known variously as Rhoplex B-74 and Primal B-74. It is believed that both of these products are substantially identical latexes. However, the components of both of these products are maintained as trade secrets, and routine analyses and the application of ordinary skill have failed to provide duplicate or alternative products.

The trade-secret nature of these commercial latexes is a detriment, particularly on those occasions when, due to quality variation or other reasons, the supply of usable material diminishes. Even when a steady supply of satisfactory commercial latex is available, the emulsion filming process itself must be performed within rather rigid limits. For example, yield from emulsion filming is quite sensitive to such parameters as: total non-volatile concentration in the filming emulsion, pH of the incoming latex, temperature of the screen when the emulsion is dispensed, heating and drying conditions, the thickness of the dry coating and the baking-out conditions.

Should commercial latexes become unavailable, it is desirable to have an alternative source of latex that could be used. Other known filming methods cannot be substituted easily, since they employ organic-solvent-based polymers and therefore require special safety equipment that is not required or used with emulsion filming.

An important factor in successful emulsion filming is the composition of the filming emulsion, and its single most important component is the latex that is used. Thus, it is desirable to provide an emulsion-filming latex having a specifically-identified composition which can be quality controlled by chemical or instrumental analyses rather than by trial-and-error experiments.

SUMMARY OF INVENTION

The novel method of metallizing a phosphur screen includes, as in prior methods, the steps of (a) coating said phosphor screen with a filming emulsion, (b) drying said coating, thereby forming a volatilizable substrate on said phosphor screen, (c) depositing a metal layer on said substrate, and then (d) volatilizing said substrate. In the novel method, the filming emulsion contains as its major solids constituent particles of an acrylic copolymer consisting essentially of 34 to 80 weight percent of one member of the group consisting of methyl methacrylate and ethyl methacrylate,
20 to 60 weight percent ethyl acrylate, and
1 to 14 weight percent methacrylic acid.

The filming emulsion may also include silica, water-soluble polymer and/or a dispersing agent in minor proportions with respect to the concentration of the latex solids in the emulsion.

DESCRIPTION OF THE PREFERRED EMBODIMENTS

As stated above, the novel method includes the steps of (a) coating a phosphor screen with a filming emulsion, (b) drying said coating, thereby forming a volatilizable substrate on said phosphor screen, (c) depositing a metal layer on said substrate, and then (d) volatilizing said substrate. In the novel method, the filming emulsion contains as its major solids constituent particles of an acrylic copolymer consisting essentially of 34 to 80 weight percent of one member of the group consisting of methyl methacrylate (MMA) and ethyl methacrylate (EMA),
20 to 60 weight percent ethyl acrylate (EA), and
1 to 14 weight percent methacrylic acid (MAA).

Within this range are two narrower compositional ranges of particular interest, with the preferred range indicated in parenthesis as follows:

43 to 65 (51 to 58) weight percent MMA
30 to 50 (36 to 43) weight percent EA
1 to 14 (4 to 8) weight percent MAA and
58 to 75 (62 to 72) weight percent EMA
22 to 35 (23 to 35) weight percent EA
1 to 10 (4 to 8) weight percent MAA The major solids constituent of the filming emulsion used in the novel method is a water-insoluble film-forming acrylic copolymer which is introduced as an aqueous latex. This copolymer can be volatilized into gaseous fragments by heating at temperatures of about 400° to 440° C. The copolymers, which are synthesized by unusual emulsion polymerization methods, are relatively hard and thermoplastic. The latexes which are most useful tend not to wet glass.

The useful latexes may be prepared by reacting in an aqueous medium a mixture consisting essentially of a monomer mixture in one of the above-mentioned compositional ranges. The monomer mixture is preferably added with continuous stirring to water whose temperature is maintained in the range of about 68° to 78° C. The aqueous medium preferably contains low concentrations (about 0.25 to 1.0 weight percent based on weight of monomers) of an anionic surfactant, such as dodecyl sodium sulfate. Polymerization is best initiated with a water-soluble free-radical source such as potassium persulfate. Each of the copolymer compositions disclosed herein is assumed to be the same as the monomer mixture used for its synthesis.

The filming emulsions for the novel process are aqueous emulsions of film-forming resins which may contain minor amounts of additives. A water-soluble film-forming polymer (such as the borate complex of polyvinyl alcohol) may be included as an additive in the filming emulsion in an amount of about 0.3 to about 1.2 weight percent of the emulsion. This additive is believed to aid in the formation of a uniform substrate for the metal layer, and to maintain film integrity over the surface of the phosphor screen. In these ways, blistering of the metal film during the subsequent baking-out step is inhibited. Higher concentrations adversely affect the specular properties of the metal layer that is deposited over the substrate without significantly improving the blister resistance of the substrate and metal layer; lower concentrations are ineffective and tend to result in a mottled appearance of the sidewall after baking out.

Colloidal silica may be included as an additive in the filming emulsion. Colloidal silica has the effect of reducing the peeling of the metal layer from bare glass areas during baking-out. It also enhances the efficiency of baking-out, thus inhibiting the formation of observable residue ("browning") in the completed screen.

One or more dispersing agents may be included as additives in the filming emulsion, preferably non-ionic surfactants. A dispersing agent can reduce the amount and intensity of cosmetic blemishes, such as streaks and mottle. When used, dispersing agents constitute about 0.05 to 0.20 weight percent of the filming emulsion.

Hydrogen peroxide is often included as an additive in prior filming emulsions in an amount of about 0.1 to 4.0 weight percent of the total weight of the emulsion where it functions to regulate the porosity of the substrate and of the metal layer. With no hydrogen peroxide present, the processing cycle must be carefully adjusted to avoid defects in the metal layer after baking-out. In optimum practice of the novel method, hydrogen peroxide is omitted from the filming emulsion. No detriment is experienced when the hydrogen peroxide is included.

The novel filming method may be applied to any phosphor screen including structured screens, such as dot screens and line screens, and unstructured screens, such as monochrome screens and penetration screens. Structured screens may include nonluminescent areas such as guard bands or other masking structures. The novel filming method may be applied to phosphor screens comprised of any substantially water-insensitive phosphor or combination of phosphors, and to phosphor screens which have been fabricated by any screening process.

In the novel method, a quantity of filming emulsion is dispensed upon and spread over the screen surface. It is important (for proper spreading and for the removal of excess emulsion) that the screen is spinning during and after dispensing. During heating and drying, a speed of rotation up to about 165 rpm. can be used to adjust the spreading and the draining of the emulsion to achieve the substrate thickness and uniformity desired with the screen and the emulsion that are being used.

In applying the filming emulsion to a screen surface by the slurry technique, the emulsion is spread over the screen with a puddle of emulsion traveling in a spiral over the surface of the screen. In preferred applications, the panel rotates and tilts from near horizontal (axis at 0° to 5° angle from vertical) to a 15° to 18° angle. The axis is then tilted quickly to an angle of about 85° or more in order to spin-off the excess emulsion. Infrared heat is then applied to dry the coating. Near the end of the drying cycle, the filmed screen exhibits a maximum post-heating temperature of about 46° C.

In practice, the emulsion wets the screen surface readily and fills the screen pores or capillaries, and some of the emulsion solids are deposited over the screen surface due to imbibition of water from the emulsion. The presence of the water-soluble polymer enhances the uniformity in this step. Variations in the texture and the size of the capillaries across the phosphor screen may require adjustment of the filming cycle and emulsion solids to optimize the performance of the filming step.

Following filming, the dry film or substrate is metallized in a manner similar to that previously described; for example, in U.S. Pat. Nos. 3,067,055 and 3,582,390, op. cit., preferably with aluminum metal. Subsequently, the metallized substrate is baked-out in air at about 400° to 440° C. During this baking-out, organic matter in the screen and in the substrate is volatilized, and the metal layer adheres to the phosphor screen. After baking-out, a small amount of inorganic residue is usually left by the substrate. The source of some of this residue may be the additives in the novel filming emulsions. Following baking-out, the panel with the metallized phosphor screen thereon is assembled with other structures into a cathode-ray tube. Alternatively, the unbaked screen may be assembled with other structures first and then baked-out as described above to volatilize any organic matter in the screen and in the substrate.

The following is an example of the novel method for metallizing a phosphor screen. In this example, the slurry technique is employed to apply the filming emulsion to a dry tricolor mosaic screen for a color television picture tube. This screen consists of phosphor elements that may be in the form of parallel stripes or of dots arranged in a hexagonal pattern on the surface of a glass faceplate. The phosphor screen is composed of phosphor elements of a blue-emitting phosphor (e.g., zinc sulfide activated with silver); a green-emitting phosphor (e.g., zinc cadmium sulfide activated with copper and aluminum); and a red-emitting phosphor (e.g., yttrium oxysulfide activated with europium). The elements contain about 8 to 24 percent of a light-hardened binder comprising principally polyvinyl alcohol, acrylic copolymers and a chromium salt. The steps in the metallization are substantially those described in U.S. Pat. No. 3,582,390 op. cit., except that the temperature of the screen when the emulsion is applied may be extended to the range of 34° to 51° C.

The filming emulsion for this example may be prepared with the following stock solutions:

Solution A—a latex (which is described below) containing about 38 weight percent of acrylic copolymer and having a pH of about 2.9, Solution B—an aqueous solution containing about 2 weight percent of a boric acid complex of polyvinyl alcohol prepared by mixing a sufficient quantity of Unisize HA70 (marketed by Air Products Company, New York, N.Y.) with deionized water, and Solution C—an aqueous solution containing about 30 weight percent of colloidal silica particles, such as the solution sold commercially under the name Ludox AM (marketed by E. I. duPont de Nemours, Wilmington, Del.)

To prepare the filming emulsion, mix 237 grams of Solution A with 258 grams of water. Then, while mixing, add 15 grams of Solution C. Then, add sufficient 28-percent ammonium hydroxide to adjust the pH of the mixture to about 6.0 to 7.5, preferably about 7.2. Then, with mixing, add 90 grams of Solution B. The filming emulsion may now be used in the procedure set forth above.

In certain applications, we have observed that screens made using the novel filming emulsions have a streaked appearance after baking-out. The streaks are cosmetic blemishes and can in general not be seen in a finished tube. Small amounts of surfactant added to the filming emulsion will reduce the streakiness of the screens. A nonionic surfactant such as Triton DF-16, a product of the Rohm and Haas Co., Phila., Pa., is preferred. The preferred concentration is about 0.05 to 0.20 weight percent of the filming emulsion. Other surfactants that may be used (in about the same quantities) are Triton N-100 and Triton X-100. Both of these surfactants are marketed by Rohm and Haas Co.

The following is an example of the synthesis of a latex preferred for use in the novel method. A 12-liter resin flask is equipped with a mechanical stirrer (with jacketed bearing) whose speed can be monitored and controlled, a reflex condenser, a thermometer, an addition funnel and a nitrogen inlet tube. Approximately one gallon of latex is prepared as follows: 480 grams of water are charged to the flask and heated with stirring to about 66° C. using a water bath maintained at 70° C. To the stirred and heated water is added at a uniform rate over a four-hour period a dispersion prepared by stirring together 2,020 grams of water, 5.625 grams of dodecyl sodium sulfate (DSS), 3.75 grams of potassium persulfate, 817.8 grams of MMA, 592.2 grams of EA, and 90.0 grams of MAA. The mechanical stirrer in the flask is controlled as closely to 450 to 460 rpm as possible; the nitrogen flow rate is 0.3 to 0.4 scfh; the reaction temperature is maintained in the range of 65° to 78° C. by raising or lowering the water bath and cooling with running water if required. After 80 percent of the dispersion is added, the water bath temperature is raised to 75° C., and this is maintained for the remainder of the addition period and for one hour following the end of the addition. The flask is then cooled and the latex filtered through Miracloth. The yield of the filtered latex is about 96.1%. It has a pH of about 2.77, an acid number of about 14.6, and its nonvolatile content is about 37.5%. The solids are transparent, hard, and have a glass transition temperature (as determined using differential scanning calorimetry on cast latex after annealing) of about 67.5° C.

Five separate batches of this latex may be blended together by mechanical stirring to prepare about five gallons of the latex from which filming emulsions were prepared. The blending is not necessary and is performed to give sufficient material for thorough evaluation in a factory environment. The synthesis is quite reproducible in terms of the performance of replicate latexes in filming emulsions. The blended latex was used to prepare screens A-1 to A-6 in the TABLE below.

An example of a filming emulsion containing the latex prepared by the method described immediately above contains: latex, about 15% by weight; Unisize, about 0.6% by weight; Ludox, about 0.75% by weight; and Triton DF-16, about 0.1% by weight. This filming emulsion is applied to 21V tricolor screens by standard methods and dried. Aluminum metal is then vapor-deposited under low ambient pressure on the dry screen. Then, at atmospheric pressure, the metallized structure is baked in air at about 425° C. for about 30 minutes, and then cooled. Test screens are subjectively graded: acceptable (salable), good (better than acceptable) and poor (not salable). The grade involves the determination of six properties of the screen after baking-out. These are:

1. Luminous efficiency is the relative light output of the test screen (in foot-lamberts per milliampere) excited under a standard set of conditions compared with the light output from a similar control screen which was prepared using a prior filming emulsion based on Rhoplex B-74 and containing hydrogen peroxide and applied and processed under optimum conditions. The luminous efficiency is reported as a percentage of the light output of the control screen. A screen having a luminous efficiency of 100 has a luminous efficiency equal to that of the control screen.
2. Screen blisters are reported on a scale from 0 (no blistering) to 4 (entire screen is covered with large blisters).
3. Radius blisters are reported on a scale of 0 (no blistering) to 4 (nonadherent aluminum on the radius of the screen).
4. Mottle means the uniformity of the appearance of the aluminum metal in non-phosphor-containing areas of the screen (the radius and sidewalls). The value reported is on a scale of 0 (completely uniform) to 4 (severly blotched).
5. Streaks are reported on a scale of 0 (none or very faint) to 4 (visible in the ambient with the screen not excited).
6. Luster is a measure of the reflectivity of the aluminum in the radius and sidewall areas of the screen and is reported on a scale of 0 (very brightly reflective) to 3 (dull). Note that this property may have a value of 3 and the tube still be salable provided mottle is low.

The TABLE lists examples of screens prepared with various filming emulsions to show the scope of the novel method, the ratings for the six properties and the grade. Each copolymer composition is assumed to be the same as the monomer mixture used for its synthesis. Each of the copolymers, except for Screens B and C, was prepared with 0.375% DSS surfactant. The copolymer for Screen C was prepared with 1.0% DSS, and for Screen B the copolymer was prepared with 0.5% EP-110 surfactant. Each of the filming emulsions contained 0.6% Unisize and 15% copolymer solids except for screens D-2, H and I, which contained 16%, 13% and 13% respectively of copolymer solids. Each of the filming emulsions contained 0.50% Ludox except for screens A-1, A-2, A-5, C and D-2, which contained 0.75% Ludox. The emulsions contained 0.1 or 0.2% added surfactant except for the emulsions for screens D-1, E, F and H through M. All of the films were formed by spinning the panel at about 110 rpm except for A-5, which was spun at about 160 rpm.

The screens listed in the TABLE are not presented in the historical order in which they were made, but are grouped to illustrate the novel method. The screens listed in the TABLE were all prepared with three-component copolymers. Although some screens are rated poor, it is noteworthy that acceptable screens with the same copolymer are listed. Screens made with copolymers other than those within the novel method are generally unacceptable. Included among these are screens made with two-component copolymers containing only two of the monomer group: MMA, EMA, EA, and MAA. All of the screen structures made with two-component copolymers either blistered or gave unacceptable luminous efficiency. The same was true of blends of two-component copolymers which, by addition, have the same total monomer proportions as the three-component copolymer compositions shown in the compositional range used in the novel method. Four-component copolymers were also synthesized with no useful materials resulting. The same was found to be true for copolymers which contained n-butyl or isobutyl acrylate or methacrylate, 2-hydroxyethyl or 2-hydroxypropyl methacrylate. Some copolymers containing methyl acrylate were found to be useful but were not superior in performance to the more easily synthesized and quality controlled three-component MMA/EA/MAA or EMA/EA/MAA copolymer latexes. Use of acrylic acid or itaconic acid instead of MAA resulted in more difficult polymerizations and poorer performing products.

Latexes synthesized using non-ionic surfactants (also not listed as examples) or in the absence of surfactant were inferior to the example materials of the same composition. Certain other surfactants of the anionic type, notably the sodium or ammonium salts of sulfonated ethoxylated phenols (for example, Alipal EP-110, a product of GAF Corporation), may be used to synthesize useful latexes by the novel method. Others, such as the Triton X series (Rohm and Haas Co.) are not useful.

The results listed in the TABLE suggest that, for MMA/EA/MAA copolymers, the preferred amount of MAA is 4 to 8 percent. The optimum ratio of MMA/EA is in the range from 40/60 to 60/40 and preferably from 55/45 to 60/40. For copolymers synthesized from EMA, EA, and MAA the optimum MMA/EA ratios are from about 60/40 to about 80/20 with the preferred range being from about 70/30 to 75/25. Again, the preferred MAA level is in the 4 to 8 percent range.

The latex copolymers used in the novel process contain an alkyl methacrylate, methacrylic acid and ethyl acrylate repeating units. From studies of the thermal degradation of polymers and from studies of pyrolysis-gas-chromatographic analysis of polymers, it is well-established that polymers of acrylate esters degrade less efficiently at elevated temperatures than do polymers of methacrylate esters. The ceiling temperatures (the temperature at which a polymer will degrade to monomer) for poly(acrylates) are higher than those for corresponding poly(methacrylates), and the pyrolysis yields for poly(acrylates) are lower and their tendencies to char are higher than for corresponding poly(methacrylates). Since one of the requirements in filming is the efficient volatilization of the substrate during baking-out, it is surprising that latexes synthesized in part from ethyl acrylate are useful, indeed preferable, to previously-used latex materials. In fact, other alkyl acrylates have not been found to form latexes that are useful in this method. Thus, latexes in which (a) methyl acrylate or butyl acrylate was substituted for all or part of the ethyl acrylate, and (b) acrylic acid was substituted for methacrylic acid, generally performed more poorly in filming than the latexes listed in the TABLE.

The filming emulsions employed in the novel method may be applied using machines that are normally used in the industry. Spin speeds, panel positioning, and amount dispensed will be similar to those used for prior filming emulsions and will vary somewhat with the screen type. As is the case of the prior filming emulsions, control of application and drying temperatures is important. An advantage of the novel method is that the filming emulsions may be applied at significantly lower temperatures and over a somewhat wider range of temperatures than are required for prior-art emulsions. The preferred application temperature (screen temperature at dispensing) is in the range of 34° to 51° C., with 37° to 38° C. being optimum. The preferred post-heating temperature range (screen temperature at the end of the coating-and-drying cycle) is 44° to 50° C., with 45° to 46° C. being optimum. Generally, lower post-heating temperatures are associated with compositions with lower MMA/EA and EMA/EA ratios.

Under these conditions, screens comparable in performance to those produced using prior filming emulsions can be prepared, and tubes made from them are of commercial quality. The novel method has the following additional advantages: simpler formulation of the filming emulsion; lower filming temperatures, resulting in lower cost; a well-characterized (therefore more easily quality-controlled) latex, resulting in more consistent production yields and the ability to achieve multiple sourcing; lower odor, resulting in a more pleasant and safer working environment; very low concentration in the latex of inorganic materials, such as emulsifiers, resulting in lower contamination of the final screen after baking-out; increased temperature latitude in filming and increased formulation latitude in the preparation of the filming emulsion due to the compatibility of the latex with added surfactants, each resulting in potentially greater ease of use with nonstandard screen types.

TABLE

| | Copolymer Composition | | | | Property | | | | | | |
|---|---|---|---|---|---|---|---|---|---|---|---|
| Screen | MMA | EA | EMA | MAA | 1 | 2 | 3 | 4 | 5 | 6 | Grade |
| A-1 | 54.5 | 39.5 | — | 6.0 | 100 | 0 | 0 | 0 | 2 | 2 | Good |
| A-2 | 54.5 | 39.5 | — | 6.0 | 94 | 0 | 0 | 0 | 1 | 2 | Poor |
| A-3 | 54.5 | 39.5 | — | 6.0 | 97 | 0 | 0 | 1 | 0 | 2 | Acceptable |
| A-4 | 54.5 | 39.5 | — | 6.0 | 97 | 0 | 0 | 1 | 1 | 2 | Acceptable |
| A-5 | 54.5 | 39.5 | — | 6.0 | 99 | 0 | 0 | 0 | 0-1 | 2 | Good |
| A-6 | 54.5 | 39.5 | — | 6.0 | 99 | 0 | 0 | 1 | 2 | 2 | Acceptable |
| B | 54.5 | 39.5 | — | 6.0 | 97 | 0 | 0 | 0 | 0 | 2 | Acceptable |
| C | 54.5 | 39.5 | — | 6.0 | 97 | 0 | 0 | 0 | 2 | 2 | Acceptable |
| D-1 | 56.4 | 37.6 | — | 6.0 | 95 | 0 | 0 | 0 | 2 | 2 | Acceptable |
| D-2 | 56.4 | 37.6 | — | 6.0 | 93 | 0 | 0 | 0 | 1 | 2 | Poor |
| E | 61.1 | 32.9 | — | 6.0 | 67 | 0 | 0 | 0 | 2 | 2 | Poor |
| F | 52.6 | 41.4 | — | 6.0 | 102 | 0 | 0 | 0 | 2 | 2 | Good |
| G | 51.7 | 42.3 | — | 6.0 | 102 | 0 | 0-1 | 0 | 2-3 | 2 | Acceptable |

TABLE-continued

| Screen | Copolymer Composition MMA | EA | EMA | MAA | Property 1 | 2 | 3 | 4 | 5 | 6 | Grade |
|---|---|---|---|---|---|---|---|---|---|---|---|
| H | 46.0 | 46.0 | — | 8.0 | 97 | 0 | 0 | 0 | 2 | 1 | Acceptable |
| I | 37.6 | 56.4 | — | 6.0 | 97 | 0 | 0 | 0 | 2 | 2 | Acceptable |
| J | — | 26.3 | 67.7 | 6.0 | 99 | 0 | 0 | 0 | 2 | 3 | Good |
| K | — | 28.2 | 65.8 | 6.0 | 100 | 0 | 0 | 0 | 2 | 3 | Good |
| L | — | 23.5 | 70.5 | 6.0 | 93 | 0 | 0 | 1 | 2 | 2 | Poor |
| M | — | 42.3 | 51.7 | 6.0 | 103 | 0 | 2 | 2 | 2 | 2 | Poor |

We claim:

1. A method of metallizing a phosphor screen including the steps of (a) coating said phosphor screen with an aqueous emulsion containing an acrylic copolymer, (b) drying said coating, thereby forming a volatilizable substrate on said phosphor screen, (c) depositing a metal layer on said substrate and then (d) volatilizing said substrate, characterized in that said copolymer consists essentially of about 34 to 80 weight percent of one member of the group consisting of methyl methacrylate and ethyl methacrylate, 20 to 60 weight percent ethyl acrylate and 1 to 14 weight percent methacrylic acid.

2. The method defined in claim 1 wherein said copolymer consists essentially of about 43 to 65 weight percent methyl methacrylate, 30 to 50 weight percent ethyl acrylate and 1 to 14 weight percent methacrylic acid.

3. The method defined in claim 2 wherein said copolymer consists essentially of about 51 to 58 weight percent methyl methacrylate, 36 to 43 weight percent ethyl acrylate and 4 to 8 weight percent methacrylic acid.

4. The method defined in claim 1 wherein said copolymer consists essentially of about 58 to 75 weight percent ethyl methacrylate, 22 to 35 weight percent ethyl acrylate and 1 to 10 weight percent methacrylic acid.

5. The method defined in claim 4 wherein said copolymer consists essentially of about 62 to 72 weight percent ethyl methacrylate, 23 to 35 weight percent ethyl acrylate and 4 to 8 weight percent methacrylic acid.

6. The method defined in claim 1 wherein said emulsion contains minor proportions of at least one of (a) colloidal silica, (b) water-soluble polymer and (c) dispersing agent.

7. The method defined in claim 6 wherein said water-soluble polymer is a boric acid complex of polyvinyl alcohol.

8. The method defined in claim 6 wherein said dispersing agent is a non-ionic surfactant.

* * * * *